US007300332B2

(12) United States Patent
Kobayashi et al.

(10) Patent No.: US 7,300,332 B2
(45) Date of Patent: Nov. 27, 2007

(54) POLISHED STATE MONITORING APPARATUS AND POLISHING APPARATUS USING THE SAME

(75) Inventors: Yoichi Kobayashi, Tokyo (JP); Ryuichiro Mitani, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 10/568,085

(22) PCT Filed: Jun. 16, 2004

(86) PCT No.: PCT/JP2004/008787

§ 371 (c)(1),
(2), (4) Date: Jul. 26, 2006

(87) PCT Pub. No.: WO2005/025804

PCT Pub. Date: Mar. 24, 2005

(65) Prior Publication Data

US 2006/0274326 A1 Dec. 7, 2006

(30) Foreign Application Priority Data

Sep. 10, 2003 (JP) ..... 2003-318307

(51) Int. Cl.
*B24B 49/00* (2006.01)
*B24B 1/00* (2006.01)

(52) U.S. Cl. ..... 451/5; 451/6; 451/41; 451/285

(58) Field of Classification Search ..... 451/5, 451/6, 8, 41, 63, 285–290; 438/691–693; 700/164

See application file for complete search history.

(56) References Cited

U.S. PATENT DOCUMENTS 5,433,651 A * 7/1995 Lustig et al. ..... 451/6
5,838,447 A * 11/1998 Hiyama et al. ..... 356/600
5,964,643 A * 10/1999 Birang et al. ..... 451/6
6,159,073 A * 12/2000 Wiswesser et al. ..... 451/6
6,399,501 B2 * 6/2002 Birang et al. ..... 438/692
6,409,576 B1 6/2002 Oguri et al.
6,506,097 B1 * 1/2003 Adams et al. ..... 451/5
6,632,124 B2 * 10/2003 Adams et al. ..... 451/5
6,991,516 B1 * 1/2006 David et al. ..... 451/5

(Continued)

FOREIGN PATENT DOCUMENTS

EP 1 072 359 A2 1/2001

(Continued)

*Primary Examiner*—M. Rachuba
(74) *Attorney, Agent, or Firm*—Wenderoth, Lind & Ponack, L.L.P.

(57) ABSTRACT

A polished state monitoring apparatus capable of easily grasping the progress of polishing is provided. The polished state monitoring apparatus monitors the progress of polishing of a surface to be polished by obtaining a characteristic value indicating a state of the polished surface of an object at each sampling point every predetermined interval while scanning the surface. The apparatus includes light emitting means capable of emitting light for irradiating the surface and computing units for receiving light reflected from the surface to generate a characteristic value. Then, the apparatus fetches the characteristic values obtained from the sampling points at the same sampling timing during each scan and outputs the characteristic values. This enables the progress of the polishing to be monitored in accordance with the distance from the center of the surface.

16 Claims, 6 Drawing Sheets

U.S. PATENT DOCUMENTS

| | | | | |
|---|---|---|---|---|
| 7,003,148 | B2 * | 2/2006 | Shiomi et al. | 382/141 |
| 7,008,295 | B2 * | 3/2006 | Wiswesser et al. | 451/6 |
| 7,014,531 | B2 * | 3/2006 | Hansen | 451/8 |
| 7,025,658 | B2 * | 4/2006 | David | 451/5 |
| 2002/0013007 | A1 | 1/2002 | Hasegawa et al. | |
| 2002/0016066 | A1 | 2/2002 | Birang et al. | |

FOREIGN PATENT DOCUMENTS

| | | |
|---|---|---|
| JP | 2001-284300 | 10/2001 |
| WO | 02/18100 | 3/2002 |

* cited by examiner

POLISHED STATE MONITORING APPARATUS AND POLISHING APPARATUS USING THE SAME

FIELD OF THE INVENTION

The present invention relates to a polished state monitoring apparatus for measuring a characteristic value of a surface to be polished of an object to be polished such as a semiconductor wafer and deciding a timing of the end point of polishing, as well as a polishing apparatus having the polishing state monitoring apparatus.

BACKGROUND OF THE INVENTION

Chemical mechanical polishing (CMP) is already known which removes irregularities from a surface of a semiconductor wafer to flatten the surface. In the case of chemical mechanical polishing, it is necessary to complete the polishing when a film to be polished such as an interlayer insulating film becomes a desired thickness. Moreover, it may be requested to complete polishing when a film to be polished is removed and a base stopper film or barrier film appears like the case of STI (shallow trench isolation) or copper wiring film. As a means for satisfying these requests, a polished state monitoring apparatus is known which detects an end point of chemical mechanical polishing by irradiating a semiconductor wafer by a light-projecting device and detecting a change in reflectivity of a surface to be polished in accordance with the intensity of the light reflected from the wafer in order to prevent excessive or insufficient polishing.

To detect an end point of chemical mechanical polishing, a change in intensity of the light of a single-color light source, such as a semiconductor laser or a light emitting diode (LED), reflected from the polished surface or an optical characteristic such as spectral reflectance of white light reflected from the same may be used. Further, a polished state monitoring apparatus is known which calculates a thickness of a film on a wafer by using the intensity of the light reflected from a semiconductor wafer.

Some of conventional polished state monitoring apparatuses monitor a polished state of a semiconductor wafer, for example, measure a characteristic value such as a thickness by scanning a surface of a semiconductor wafer once every turn of a turntable on which a polishing material is set and sampling at a plurality of points every scan period so as to obtain a characteristic value at each sampling point (region). Specifically, a value obtained by A/D-converting the intensity of the light reflected from the surface of a semiconductor wafer at each sampling point is successively plotted as a characteristic value (Refer to Japanese Laid-open No. 2001-284300). In this case, if a light source is continuously lighted while irradiation light scans the surface of a wafer, the reflection intensity represents a region having a certain length along a scan line. This is also referred to as a sampling point hereafter. In FIG. 1(*a*), a solid line shows a scan trajectory of irradiation light on a semiconductor wafer and a circle shows a sampling point.

In this case, the scan trajectory on the semiconductor wafer differs every scan because the rotational speed of a turntable on which a polishing material is set is normally different from that of a top ring to which the wafer is attached. For example, as shown in FIG. 1(*b*), the first, second and third scans performed three consecutive times are performed along different trajectories. Points 1-1, . . . , 1-17, 2-1, . . . , 2-17, and 3-1, . . . , 3-17 are sampling points when performing the sampling 17 times on each scan trajectory.

In many cases, as is well known, a profile of a surface to be polished becomes a shape roughly axis-symmetric to the rotational center of a semiconductor wafer. In monitoring the surface to be polished, if all characteristic values obtained through a plurality of times of scans are mechanically arranged as shown in FIG. 8, a polished state of the surface to be polished at each scan is monitored. However, it is difficult to grasp a polished state at a specific position of a surface to be polished (e.g. wafer center) because characteristic values are changed in each scan operation due to an effect by the above profile. Moreover, there is a problem that the progress of polishing cannot be easily confirmed from a characteristic value because of a difference of a wiring pattern at each sampling point, a difference of a slurry state at each sampling, and the influence of electrical noise or the like.

SUMMARY OF THE INVENTION

Problems to Be Solved by the Invention

The present invention has been proposed to solve the problems of the above prior art and the object of the present invention is to provide a polished state monitoring apparatus capable of easily confirming the progress of polishing of an object to be polished and easily detecting an end point of the polishing, and a polishing apparatus having the polished state monitoring apparatus.

Means for Solving the Problem

To achieve the above object, the invention in a first aspect provides a polished state monitoring apparatus for obtaining a characteristic value indicating the state of a surface to be polished of an object at each sampling point every predetermined interval while scanning the surface, and monitoring the progress of the polishing of the surface by performing the scan a plurality of times, the apparatus comprising:

a light emitting unit capable of emitting light for irradiating the surface to be polished; and a computing unit for controlling a sampling timing of the characteristic value and receiving light reflected from the surface to generate the characteristic value, the computing unit being operable to monitor a time dependent variation of the generated characteristic value obtained from the sampling point at the same sampling timing every scan.

The invention of a second aspect is characterized in that the computing unit detects an end point of the polishing in accordance with the characteristic value obtained from pre-selected at least one sampling point of the same sampling timing.

The invention of a third aspect is characterized in that the pre-selected at least one sampling point of the same sampling timing is a sampling point substantially corresponding to the center of the surface.

The invention of a fourth aspect is characterized in that the computing unit selects a plurality of different sampling points at the same sampling timings, monitors each time dependent variation, and detects the end point of the polishing.

The invention of a fifth aspect is characterized in that the polishing is stopped when a specified number of sampling points among a plurality of different sampling points of the same sampling timings reaches the end point of the polishing.

The invention of a sixth aspect is characterized in that the computing unit outputs an average value of the characteristic values from a predetermined number of sampling points including one sampling point during the same scan and monitors a time dependent variation of the average value.

The invention of a seventh aspect is characterized in that the computing unit outputs an average value of the characteristic values from a predetermined number of sampling points including one sampling point during the same sampling timing of each of the scans and monitors a time dependent variation of the average value.

The invention of an eighth aspect is characterized by a polishing apparatus including a polished state monitoring apparatus in any one of the first to seventh aspects.

The invention of a ninth aspect provides a polished state monitoring method for obtaining a characteristic value indicating the state of a surface to be polished of an object at each sampling point every predetermined interval while scanning the surface and monitoring the progress of the polishing of the surface, the method comprising the steps of:

performing the scan a plurality of times; and monitoring a time dependent variation of the characteristic value obtained from the sampling point at the same sampling timing during each scan.

The invention of a tenth aspect is characterized by selecting at least one sampling point of the same sampling timing of each scan and detecting the end point of the polishing.

The invention of an eleventh aspect is characterized in that the at least one sampling point of the same sampling timing is a sampling point substantially corresponding to the center of the surface.

The invention of a twelfth aspect is characterized by selecting a plurality of different sampling points at the same sampling timings and monitoring each time dependent variation to detect the end point of the polishing.

The invention of a thirteenth aspect is characterized by stopping the polishing when a specified number of sampling points among the different sampling points of the same sampling timings reach the end point of the polishing.

The invention of a fourteenth aspect is characterized by outputting an average value of the characteristic values from a predetermined number of sampling points including one sampling point during the same scan and monitoring a time dependent variation of the average value.

The invention of a fifteenth aspect is characterized by outputting an average value of the characteristic values from a predetermined number of sampling points including one sampling point at the same sampling timing of each of the scans and monitoring a time dependent variation of the average value.

The invention of a sixteenth aspect provides a polishing method characterized by executing a polished state monitoring method in any one of the ninth to fifteenth aspects.

BRIEF DESCRIPTION OF THE DRAWINGS

FIG. 4(*b*) is a diagram showing three scan trajectories and sampling points on the surface to be polished of a semiconductor wafer.

FIG. 5(*b*) is a graph showing an example of a result of processing thickness values obtained from sampling points in accordance with the present invention.

FIG. 6(*b*) is a graph showing another example of a result of averaging thickness values in accordance with another averaging technique of the present invention.

DETAILED DESCRIPTION OF THE INVENTION

Figure 1A:
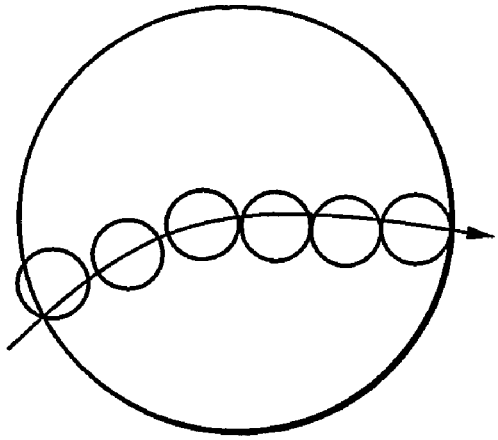
FIG. 1(*a*) and FIG. 1(*b*) are diagrams showing trajectories along which a surface to be polished of a semiconductor wafer is scanned and sampling points.
Figure 1B:
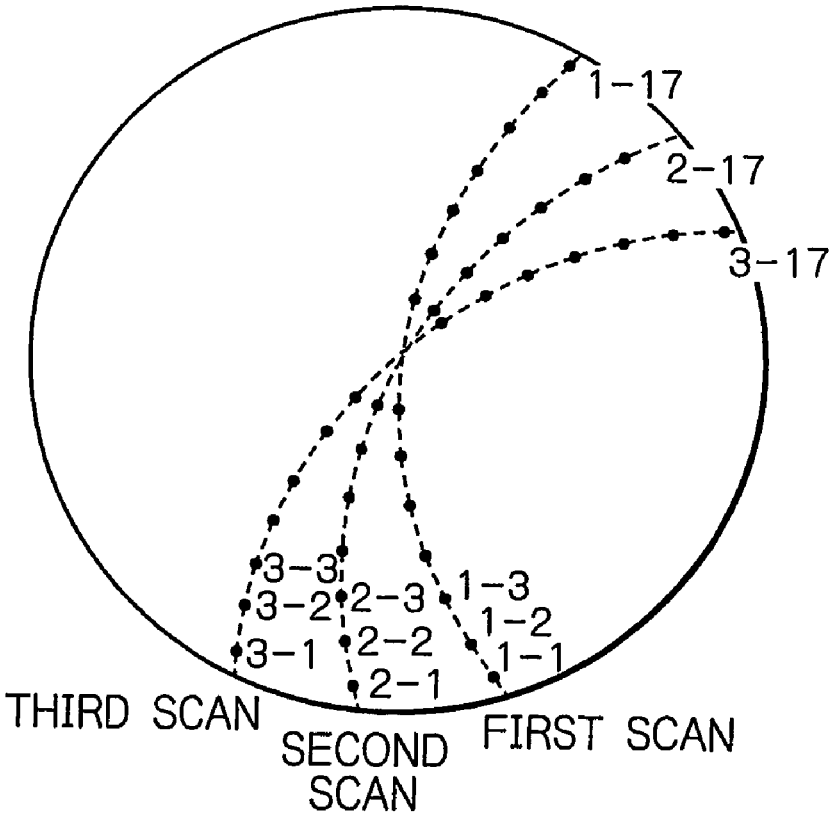

An embodiment of a polished state monitoring apparatus according to the present invention is described below in detail by referring to the accompanying drawings. In the drawings, the same or corresponding components are designated by the same symbols and any duplicate description will be omitted hereafter.

Figure 2:
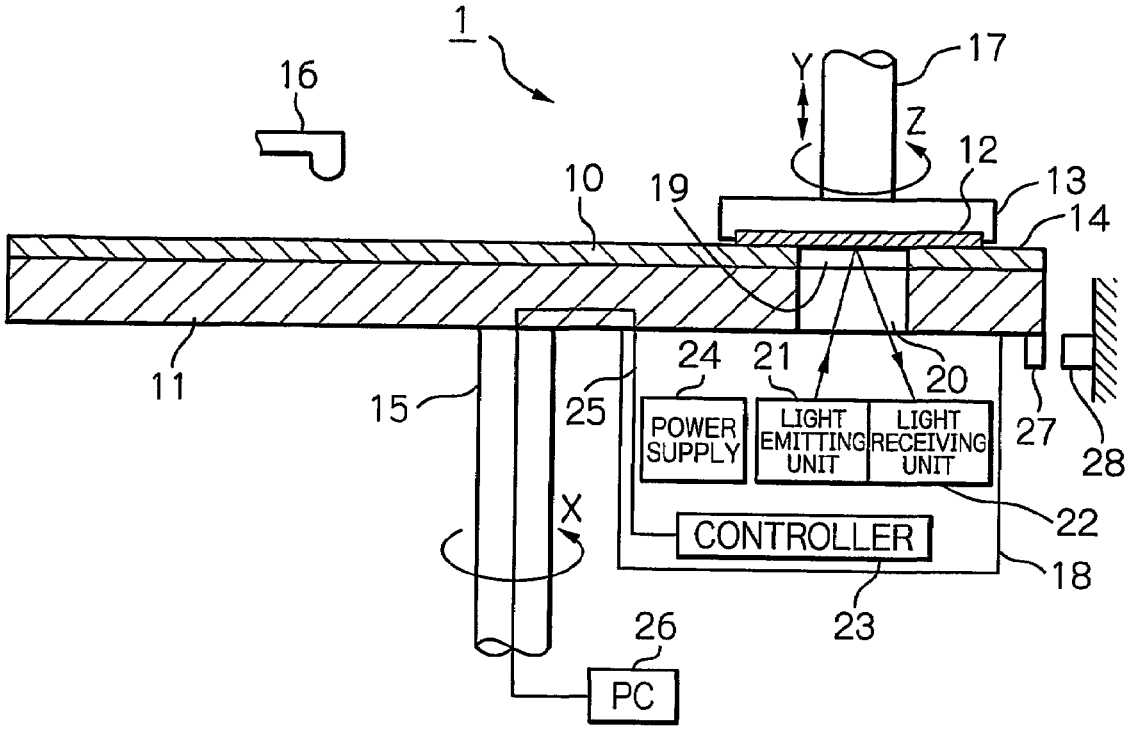
FIG. 2 is a diagram schematically showing the structure of a polishing apparatus having a polished state monitoring apparatus according to the present invention.

FIG. 2 is an illustration schematically showing a whole structure of a polishing apparatus having a polished state monitoring apparatus according to the present invention. In FIG. 2, a polishing apparatus 1 has a polishing turntable 11 on one side of which a polishing cloth 10 is affixed, and a top ring 13 for holding a semiconductor wafer 12 to press it against a surface of the polishing cloth 10. The semiconductor wafer 12 is attracted and held by a lower surface of the top ring 13. A surface 14 of the polishing cloth 10 facing the semiconductor wafer 12 is a polishing surface contacting with the semiconductor wafer 12 with friction. In this case, it is also possible to use an abrasive grain plate obtained by solidifying fine abrasive grains such as $CeO_2$ with a binder such as a resin, instead of the polishing cloth.

The center of the turntable 11 is supported by a shaft 15 and a lower portion of the shaft 15 is connected to a first driving motor (not shown). In this way, the turntable 11 is rotated about the shaft 15 by the first motor in the direction shown by an arrow X. A nozzle 16 for supplying a polishing solution onto the polishing cloth 10 is provided above the turntable 11.

The top ring 13 is connected to a second driving motor and an elevating cylinder (not shown) through a top ring shaft 17 and can go up and down in the direction shown by an arrow Y along the top ring shaft 17 and can rotate in the direction shown by an arrow Z about the top ring shaft 17. In this way, the top ring 13 can press the semiconductor wafer 12 held at a lower surface of the top ring 13 toward the polishing cloth 10 at a desired pressure, while rotating on its axis. In this case, the top ring 13 is supported so as not to move in the direction along the surface of the semiconductor wafer 12.

Therefore, the semiconductor wafer 12 is pressed against the polishing cloth 10 on the turntable 11 and polished while rotating together with rotation of the top ring 13. At this time, the polishing solution is supplied from the nozzle 16 onto the polishing cloth 10 and polishing is performed while the polishing solution exists between the surface to be polished of the semiconductor wafer 12 and the polishing cloth 10. In this case, pure water can be used as the polishing solution if fixed abrasive grains are used instead of the polishing cloth.

A polished state monitoring apparatus 18 for optically measuring a characteristic value such as thickness and color of an insulating film or metallic film on the surface to be polished of the semiconductor wafer 12 so as to monitor the progress of the polishing is provided at a proper place of the inside or lower surface of the turntable 11. To realize the optical measurement, a first window 19 is formed at a position of the polishing cloth 10 facing the semiconductor wafer 12, and a second window 20 is formed on the turntable 11 correspondingly to the first window 19. Preferably these windows 19 and 20 are formed of a material having a high light transmittance such as non-foamed polyurethane.

Figure 3:
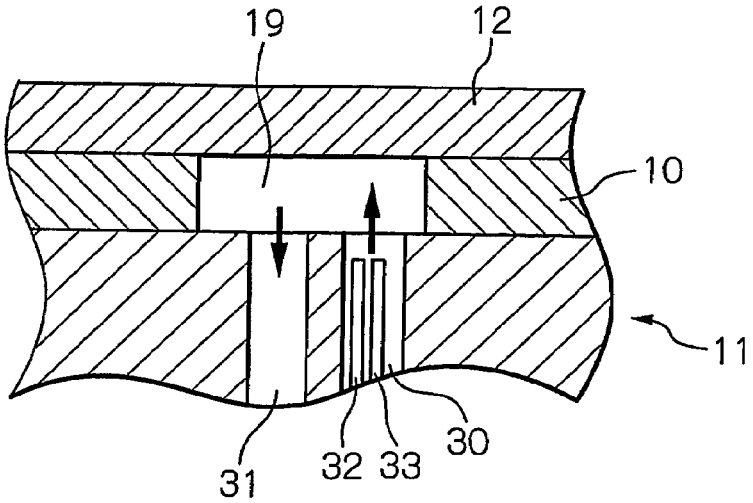
FIG. 3 is a diagram showing another optical measuring means of the polished state monitoring apparatus shown in FIG. 2.

Another optical measurement means includes fluid-type means having a fluid supply channel in the turntable 11. As shown in FIG. 3, a fluid supply channel 30 and a fluid discharge channel 31 are formed in the table instead of the second window 20. A fluid such as pure water is injected to the semiconductor wafer 12 and then discharged to the outside through the fluid discharge channel 31. Two optical fibers 32 and 33 are arranged in the fluid supply channel 30, measurement light being projected to the semiconductor wafer 12 through one of the optical fibers 32 and the light reflected from the semiconductor wafer 12 being received by the other of the optical fibers 33. The reflected light enables the progress of polishing to be monitored.

As shown in FIG. 2, a polished state monitoring apparatus 18 comprises a light emitting unit 21, a light receiving unit 22, a controller 23, a power supply 24, a cable 25 including a rotary connector, and a personal computer 26. The light emitting unit 21 emits light for irradiating the polished surface of the semiconductor wafer 12. The light receiving unit 22 receives light reflected from the polished surface irradiated with the light emitted from the light emitting unit 21, divides the reflected light into respective wavelength components and outputs electrical signals representative of intensities of light of the divided wavelength components. The controller 23 controls start and end timings of operation of the light emitting unit 21 and light receiving unit 22. The power supply 24 supplies power necessary for operations of the light emitting unit 21, light receiving unit 22 and controller 23. Preferably the light emitted from the light emitting unit 21 enters substantially vertically to the polished surface of the semiconductor wafer 12.

It is possible to use any unit as the light emitting unit 21 and light emitting means which emits light having a wavelength band including white light is preferable. The light emitting unit 21 can be a pulse turned-on type such as a xenon flash lamp or a continuously lighted type such as a tungsten halogen lamp.

An electrical signal outputted from the light receiving unit 22 is sent to the controller 23 and causes the controller 23 to generate spectrum data for the light reflected from the semiconductor wafer 12. The output of the controller 23 is connected to the personal computer 26 through the cable (including a rotary connector) 25 passing through the turntable 11 and shaft 15. Thus, the spectrum data generated by the controller 23 is sent to the personal computer 26 through the cable (including the rotary connector) 25.

Specifically, light emitted from the light emitting unit 21 is irradiated to and reflected from the surface to be polished of the semiconductor wafer 12, passes through the first window 19 and second window 20, and is received by the light receiving unit 22. The light receiving unit 22 divides the received light into a plurality of wavelength components, generates spectrum data which corresponds to each sampling point in accordance with an amount of light of each wavelength component, and sends the data to the personal computer 26.

The personal computer 26 serving as a computing unit is programmed so as to compute various characteristic values including thickness and color of the surface to be polished of the semiconductor wafer 12 in accordance with the spectrum data sent from the controller 23. The personal computer is further programmed to determine a point of time to stop the polishing or timings of changes in polishing conditions, such as rotational speed of the turntable and the top ring, pressure to be applied to a plurality of pressing regions formed on the top ring, and the types of slurry (these are also included in "polish end operation") in accordance with a time dependent variation of calculated characteristic values. Such a determination is sent from the personal computer 26 to a control unit (not shown) which controls the operation of the polishing apparatus. The personal computer 26 can also receive information on polishing conditions from the control unit.

In addition, as shown in FIG. 2, in order to detect a rotational position of the turntable 11, a proximity sensor 27 is provided at a proper position of a lower surface of the outer periphery of the turntable 11. A dog 28 is disposed at a position corresponding to the proximity sensor 27. In this way, the proximity sensor 27 detects the dog 28 every turn of the turntable 11 and sends an output to the controller 23 every time the dog 28 is detected, thereby enabling the controller 23 to detect a rotational angle with respect to a reference position of the turntable 11.

Figure 4A:
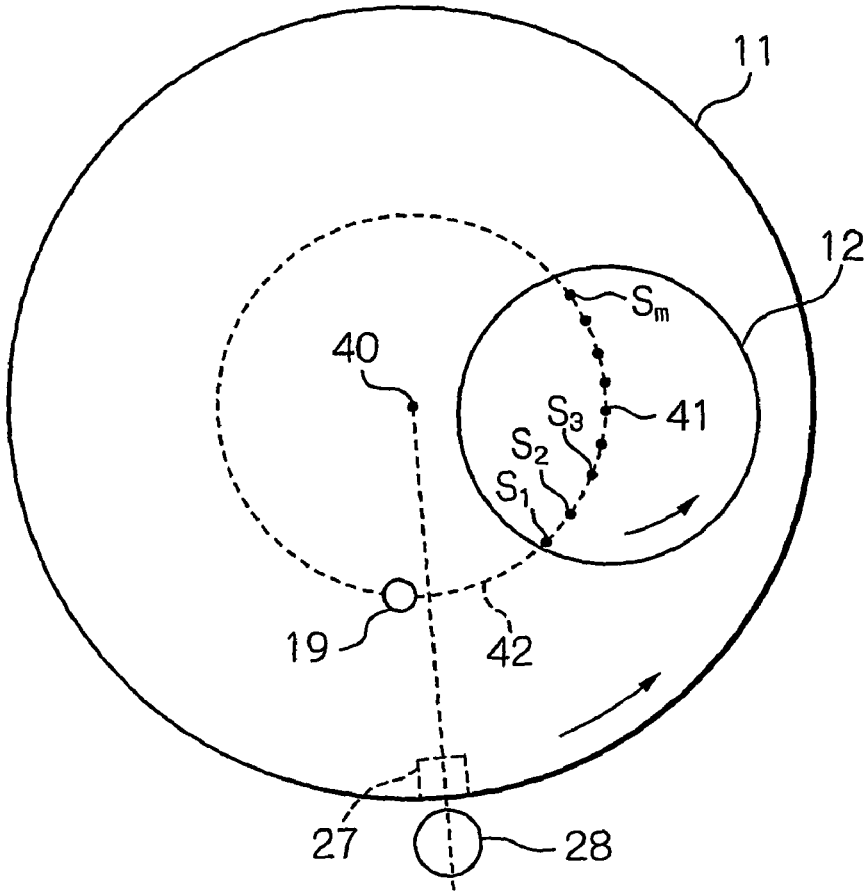
FIG. 4(*a*) is a diagram schematically showing a mutual positional relation between a turntable, a semiconductor wafer, a proximity sensor and a first window of the polishing apparatus in FIG. 2.
Figure 4B:
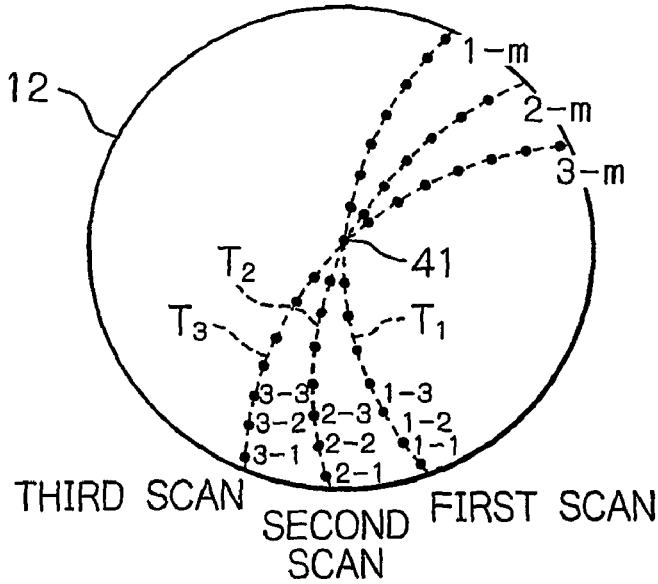

FIG. 4(*a*) is a top view schematically showing a mutual positional relation among the turntable 11, semiconductor wafer 12, first window 19, proximity sensor 27 and dog 28 at the time when the proximity sensor 27 comes to lie on the line that connects the center 40 of the turntable 11 with the dog 28. The top ring 13 is positioned so that the center 41 of the semiconductor wafer 12 exists on a circular trajectory 42 of the first window 19. Consequently, by rotating the turntable 11 and the top ring 13 in the same direction, and by operating the light emitting unit 21 at a predetermined interval when the first window 19 is under the semiconductor wafer 12 in the case of a pulse turned-on type light source so as to sample the polished surface at a sampling timing of a predetermined interval, it is possible to obtain the reflectivity, thickness and color of the polished surface at a plurality of sampling points S1, S2, . . . , and Sm on the trajectory 42. It is noted that a time period from a time when the proximity sensor 27 detects the dog 28 up to a time when the pulse-turned-on type light source starts operation or when sampling of light reflected from the polished surface is started can be adjusted to a predetermined value in accordance with the rotational speed of the turntable 11.

When the turntable 11 is rotated at a speed of, for example, 60 turns per minute and the top ring 13 is rotated at a speed of, for example, 70 turns per minute in the same direction, the trajectory for the first window 19 to scan the surface to be polished of the semiconductor wafer 12 is shifted in the same direction every turn about the center 40 of the semiconductor wafer 12 due to the difference between the rotational speeds. Such a shift appearing during three consecutive scans can be illustrated as shown in FIG. 4(*b*). Assuming that the i-th scan is called scan "i" and that the sampling point at the k-th sampling timing in the scan "i" is designated as "i-k", FIG. 4(*b*) shows the following:

(1) Characteristic values are obtained at m sampling points 1-1, 1-2, . . . , 1-*m* along a scan trajectory $T_1$ in the first scan;

(2) Characteristic values are obtained at m sampling points 2-1, 2-2, . . . , 2-*m* along a scan trajectory $T_2$ in the second scan; and (3) Characteristic values are obtained at m sampling points 3-1, 3-2, . . . , 3-*m* along a scan trajectory $T_3$ in the third scan.

Figure 5A:
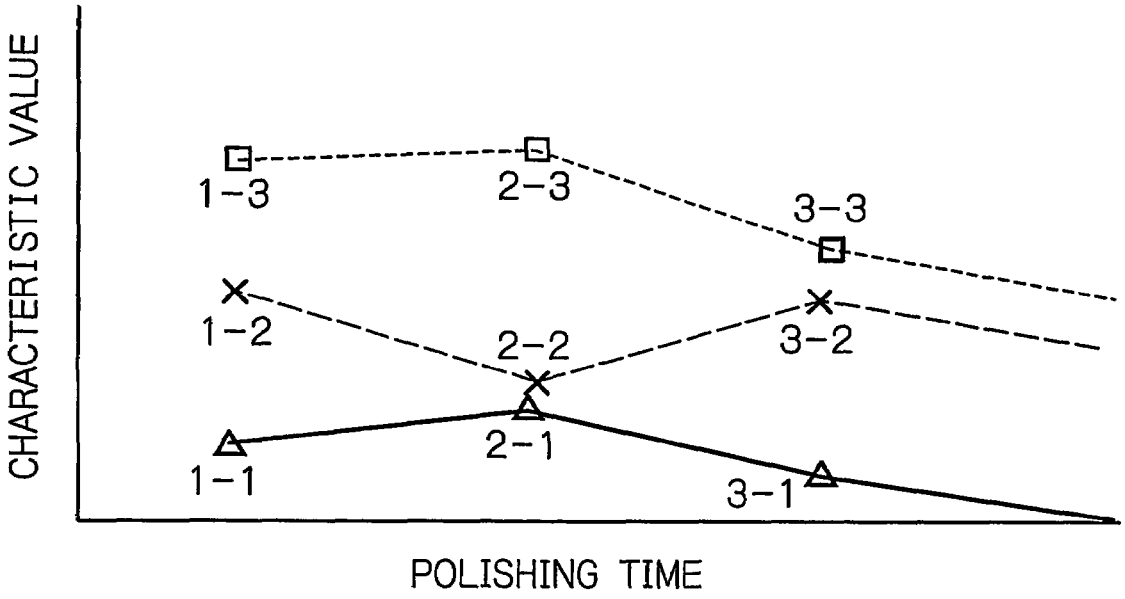
FIG. 5(*a*) is an explanatory diagram showing a method of indicating characteristic values obtained from sampling points in accordance with the present invention.
Figure 5B:
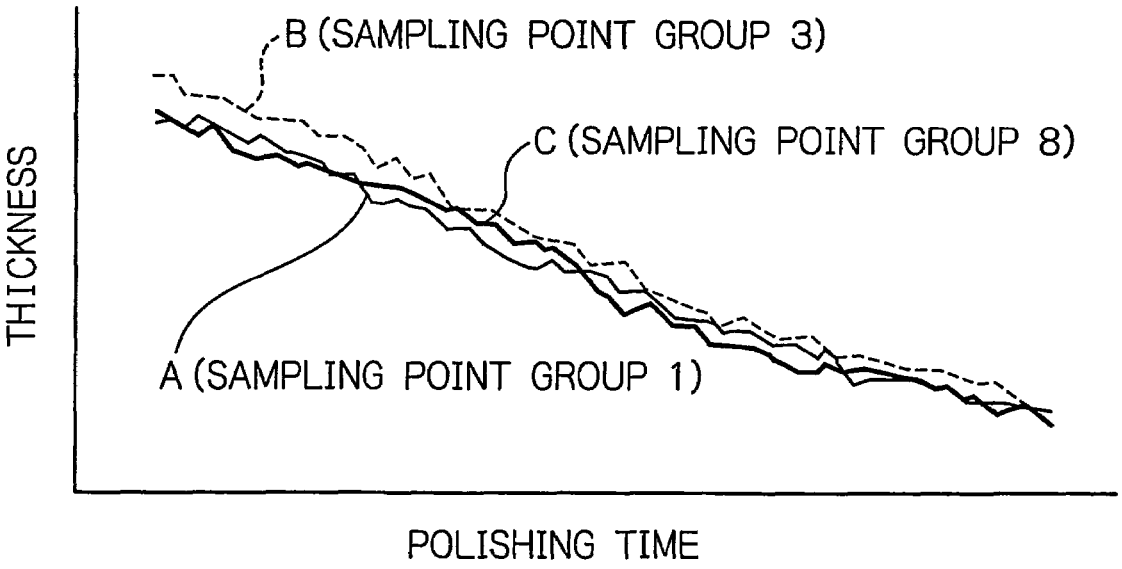

FIG. 5(*a*) is an illustrative diagram showing the progress of polishing, by interconnecting characteristic values for the same sampling numbers, that is, the same sampling timings by straight lines during the first to third scans.

In the polished state monitoring apparatus according to the present invention, if the rotational center of the top ring does not move, such a fact is used that the k-th sampling point, that is, the sampling point at the k-th sampling timing, is at almost the same distance from the center 41 of the semiconductor wafer 12 regardless of the number of times of scan. In other words, the inventors have noted that it is possible to easily and accurately confirm the progress of polishing by tracing characteristic values obtained from a sampling point group of the same number (for example, a group of the first sampling points 1-1, 2-1, 3-1, . . . , i-1, . . . ) in each scan. This is because the profile of a surface after being polished has an almost axis-symmetric shape, as is well known in a chemical mechanical polishing apparatus.

In other words, classifying many sampling points in a plurality of times of scans and referring to a group of sampling points at the first sampling timing as a sampling point group 1, a group of sampling points at the second sampling timing as a sampling point group 2, . . . , and a group of sampling pints at the k-th sampling timing as a sampling point group k, the polished state monitoring method and apparatus according to the present invention are operable to monitor the progress of polishing, by arranging, in order of time, characteristic values obtained from sampling points in the same sampling point group.

For example, assuming that a thickness is used as a characteristic value, it is possible to obtain, as shown in FIG. 5(*b*), a thickness curve A obtained from the sampling point group 1, a thickness curve B obtained from the sampling point group 3 and a thickness curve C obtained from the sampling point group 8 in the first scan, second scan, . . . , and i-th scan. Assuming that one scan has fifteen sampling points, the sampling point group 1 exists in a region close to an end portion of the semiconductor wafer 12 and the sampling point group 8 exists in a region near the center of the semiconductor wafer 12.

In general, if the sampling points at the sampling timing of the same number lie on different scan trajectories, wiring patterns corresponding to those sampling points differ, or time dependent variation of characteristic values fluctuate because of differences in step characteristics or uniformity across the surfaces. In many cases, as shown in FIG. 5(*b*), a fluctuation at an end portion of the semiconductor wafer 12 is larger than that near the center thereof. In reality, for the purpose of detecting the end point of polishing by picking more stable characteristic values, it is preferable to be able to arbitrarily select sampling points thereby detecting the end point from limited positions from which stable characteristic values can be obtained.

For example, the fluctuation of characteristic values is small in the region close to the center 41 of the semiconductor wafer 12 as is known from the solid line C in FIG. 5(*b*) showing the thickness obtained from the sampling points in the sampling point group 8. Therefore, if attention is focused on such sampling points having a small fluctuation of characteristic values, it is possible to accurately detect the end point of polish with small fluctuation.

Further, even if characteristic values are obtained from a plurality of sampling points during one scan, it is not always necessary to monitor the characteristic values from all the sampling points nor detect the end point by using the characteristic values from all the sampling points. It is also possible to monitor the progress of polishing by selecting a desired number of sampling points out of the sampling points obtained during one scan to plot the characteristic values from the sampling points at the same sampling timings as those of the selected sampling points.

If a specified number of characteristic values corresponding to the above selected sampling points are considered to have reached the end point, it is assumed that the semiconductor wafer 12 has reached the end point of polishing. For example, if it is assumed that the specified number of characteristic values is one, the polishing can be stopped at the sampling point at which the polishing has been done the fastest among the sampling points of the selected sampling point groups. This makes it possible to end a polishing operation earlier. Further, by adopting the same specified number as the number of selected sampling points, the polishing can be ended by focusing attention on the sampling point at which the polishing is done the slowest among the selected sampling points. In this way, it is possible to properly adjust the timing to end the polishing by monitoring, in parallel, changes in characteristic values obtained at sampling points at different sampling timings.

In actuality, in order to easily grasp the progress of polishing, it is preferable to use a graph having small noises or small local fluctuations. It is necessary to detect a characteristic point (such as threshold, maximum value or minimum value) with respect to a time dependent variation of characteristic value slightly before a target point of time in order to detect the end point of the polishing. Also for this reason, it is preferable to remove and smooth noises or local fluctuations from a graph of a time dependent variation of characteristic value. One technique therefor is to generate average values of characteristic values obtained from a plurality of sampling points in one scan, each average value being an average of a characteristic value and a predetermined number of previous characteristic values and a predetermined number of subsequent characteristic values. Those average values are used as second characteristic values to monitor the progress of polishing. In other words, focusing attention on each sampling point, it is permitted that each sampling point is used redundantly in order to calculate average values of characteristic values for that sampling point and also for other sampling points.

For example, assuming that m=11 in FIG. 4(*b*) and that characteristic values obtained from the sampling points 1-1, 1-2, 1-3, 1-4, 1-5, 1-6, 1-7, 1-8, 1-9, 1-10, and 1-11 in the first scan are designated as a11, a12, a13, a14, a15, a16, a17, a18, a19, a110 and a111, the second characteristic values A11, A12, A13, A14, A15, A16, A17, A18, A19, A110 and A111 can be calculated in the following:

$$A11=a11$$

$$A12=(a11+a12+a13)/3$$

$$A13=(a12+a13+a14)/3$$

$$A14=(a13+a14+a15)/3$$

$$A15=(a14+a15+a16)/3$$

$$A16=(a15+a16+a17)/3$$

$$A17=(a16+a17+a18)/3$$

$$A18=(a17+a18+a19)/3$$

$$A19=(a18+a19+a110)/3$$

$$A110=(a19+a110+a111)/3$$

$$A111=a111.$$

It is noted that the above shows simple arithmetic averages without weight, but an averaging technique is not limited to the above. For example, the averaging technique can be a harmonic average, a geometrical average or a midpoint value. In a similar manner, in other scans, an averaging operation is performed by permitting a redundant use of characteristic values obtained from individual sampling points and the second characteristic values A21-A211, A31-A311, . . . , Ai1-Ai11, . . . can be calculated. Then, the second characteristic values having the same number which appears following the number indicating the times of scan (for example, 1 next to A in the case of A12) are called as "the second characteristic values having the same number" and plotted. Specifically, groups of the second characteristic values having the same numbers, that is, a characteristic value group 1 comprised of A11, A21, . . . , Ai1, . . . , a characteristic value group 2 comprised of A12, A22, . . . , Ai2, . . . , and a characteristic value group 3 comprised of A23, . . . , Ai3, . . . are made up and the second characteristic values belonging to a characteristic value group are plotted for respective characteristic value groups, thereby obtaining curves corresponding to FIGS. 5(*a*) and 5(*b*).

In this case, it is possible that the second characteristic values are average values of characteristic values obtained from any number of adjacent sampling points. It is also possible that the characteristic values from the vicinity of the center 31 of the semiconductor wafer 12 are not averaged. In the above example, it is possible that A15=a15, A16=a16 and A17=a17. As will be understood from the above, because average values of characteristic values are obtained from one sampling point and previous and subsequent sampling points, an averaging operation can be performed even if there are a small number of sampling points, thereby bringing about such an advantage that a profile of a surface to be polished can be easily grasped.

Figure 6A:
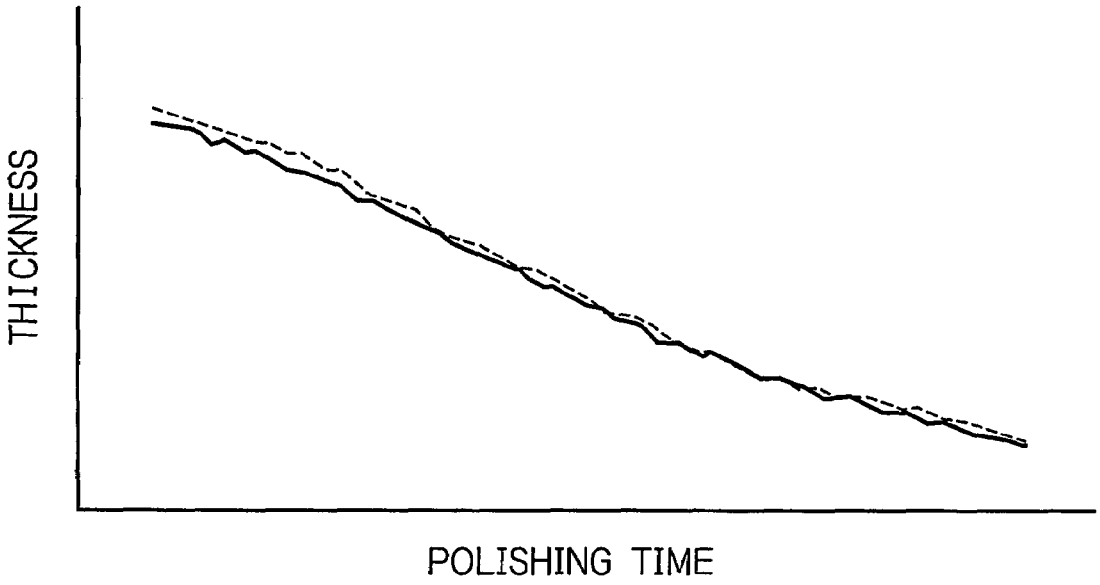
FIG. 6(*a*) is a graph showing an example of a result of averaging thickness values obtained from sampling points in accordance with the present invention.
Figure 6B:
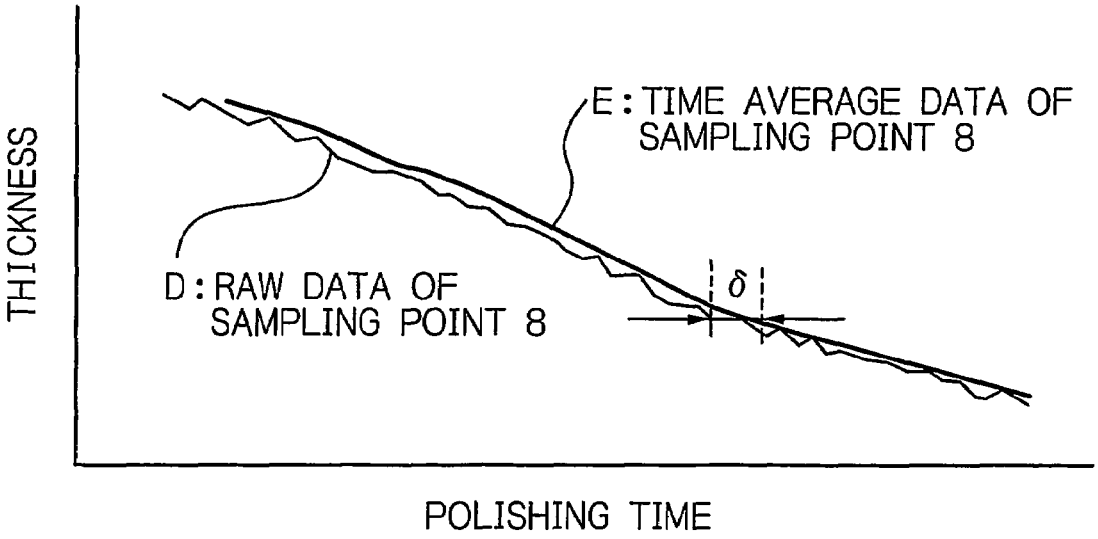

FIG. 6(*a*) shows a result of operation where the second characteristic values are obtained by performing the above averaging operation for every scan, as described above, and the second characteristic values having the same number are plotted. The solid line is obtained by plotting the second characteristic values belonging to the characteristic value group 8 in the above example and the dotted line is obtained by plotting the second characteristic values belonging to the characteristic value group 3 in the above example. Such an above averaging technique as described above is called "space average".

FIG. 6(*b*) shows a graph D of characteristic values obtained without the above averaging operation and a graph E obtained by applying another averaging technique to the characteristic values. The graph D is obtained by plotting the characteristic values obtained from the sampling point 8 near the center of a semiconductor wafer and the graph E is time-averaged values of the sampling point 8. In this example, five points are averaged and a characteristic value $B_{i,k}$ for the sampling point k of the i-th scan is expressed as $$B_{i,k}=(a_{i-4,k}+a_{i-3,k}+a_{i-2,k}+a_{i-1,k}+a_{i,k})/5.$$

This is called "time average".

Comparing the graphs in FIG. 5(*b*) with the graphs in FIG. 6(*a*), it is understood that noises or local fluctuations can be reduced by performing such an averaging technique as described above to obtain the second characteristic values and by monitoring the second characteristic values of the same number. Further, as shown in FIG. 6(*b*), the same advantage can be obtained through time averaging though a phase delay 6 is involved. It is possible to execute either the space averaging or the time averaging, and further time averaging can be applied to the second characteristic values generated by the space averaging.

Figure 7:
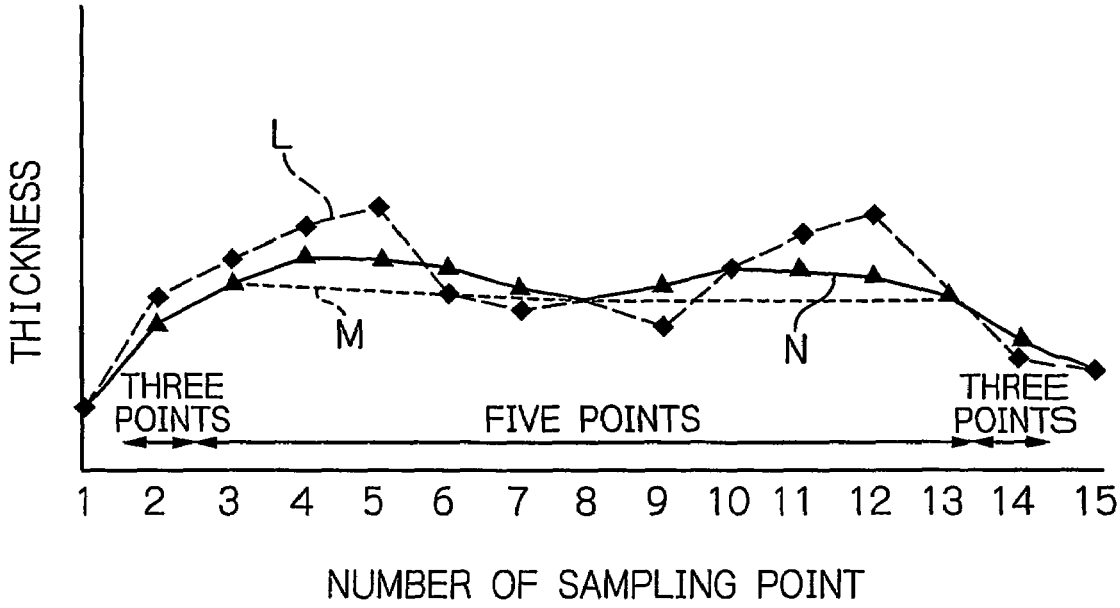
FIG. 7 is graph showing a result of performing an averaging operation in accordance with the present invention in comparison with cases in which such an averaging operation is not performed.
Figure 8:
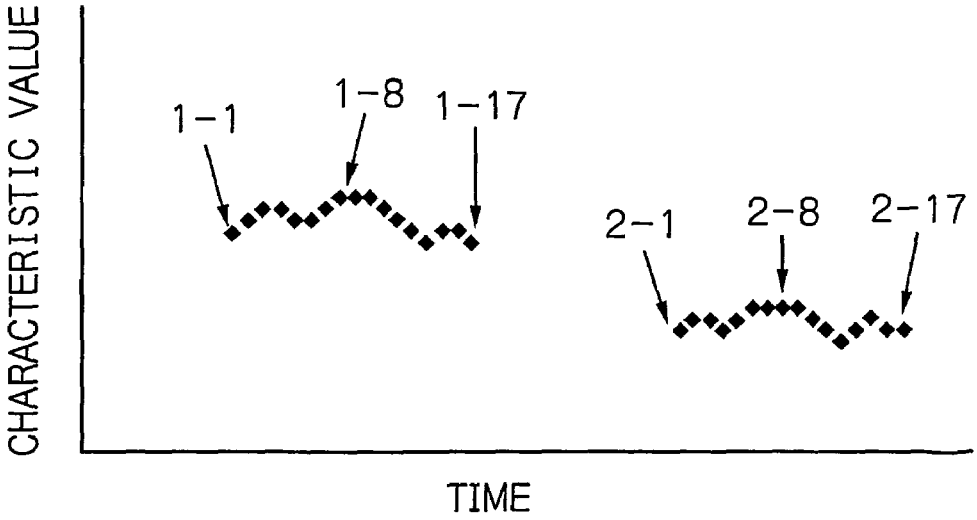
FIG. 8 is a graph in which characteristic values obtained during a plurality of scans are arranged in a time sequence.

FIG. 7 shows a profile of a semiconductor wafer having swells (irregularities) on its surface to be polished and is used to explain advantages of the space averaging. When measuring a thickness value at fifteen sampling points during one scan, raw data shown by the broken line L has been obtained. Then, average values of the thickness values from five adjacent sampling points are calculated in accordance with the polished state monitoring method according to the present invention, permitting redundant use of the thickness values, the solid line N has been obtained. It is noted that the averaging is not performed at end portions of the surface to be polished, and that an average value of the thickness values is obtained from three sampling points located one point inside of the end. In contrast, dividing fifteen sampling points into three regions each having five sampling points without overlap and obtaining respective average values, the dotted line M has been obtained.

As understood from FIG. 7, a polished state monitoring apparatus according to the present invention can be used to grasp a profile of the whole polished surface of a semiconductor wafer after smoothing local irregularities of the surface of the semiconductor wafer. As a result, in this example, it is possible to detect an end point of the polishing by focusing attention on portions near the center of the polished surface where the polishing is done relatively fast and portions outside of the central portions where the polishing is done slowly. It is noted that the number of sampling points required for the averaging operation is preferably determined every sampling point by considering the number of sampling points existing during one scan and a degree of fluctuation of the characteristic values.

Some embodiments of a polished state monitoring apparatus according to the present invention have been described heretofore. However, the present invention should not be limited to these embodiments. For example, scan trajectories have been described to be lines passing through the center of a surface to be polished, as shown in FIG. 3(*b*). However, if the position of the top ring is fixed, the scan trajectory may pass through a point other than the center of the surface to be polished. This is because, if the top ring is fixed, sampling points of the same number are arranged at substantially the same distance from the center of the surface to be polished.

INDUSTRIAL APPLICABILITY

As understood from the above described, the present invention has such advantages as follows:

(1) Because a time dependent variation of characteristic values obtained from sampling points of the same number are used, it is possible to easily grasp the progress of polishing of an object to be polished;

(2) Because a characteristic value obtained from a sampling point may be actually temporally fluctuated finely depending on the state of the polished surface of an object, it becomes easy to detect the timing of an end point of polishing by selecting specific sampling points from which stable characteristic values are obtained;

(3) Focusing attention on central sampling points of all the sampling points during one scan and monitoring the progress of polishing near the center of an object to be polished, it is possible to detect an end point of polishing accurately with a small fluctuation;

(4) Focusing attention on a desired number of sampling points and monitoring the progress of polishing, it is possible to simultaneously monitor a portion at which polishing is done fast and portions at which polishing is done slowly, thereby adjusting a timing of detecting an end point of the polishing;

(5) Averaging characteristic values obtained from one sampling point in each scan in such a manner that the characteristic values are used redundantly to calculate the second characteristic values, local fluctuations present on a surface to be polished are smoothed and a profile of the surface to be polished can easily be grasped. Because redundant use is allowed, the present invention is particularly effective when the number of sampling points during one scan is small; and (6) Because a polished state monitoring apparatus is provided which enables the progress of polishing to be easily grasped, it is possible to accurately detect an end of polishing of an object to be polished such as a semiconductor wafer.

The invention claimed is:

1. A polished state monitoring apparatus for monitoring the progress of polishing of a surface to be polished of an object by obtaining a plurality of first characteristic values from a plurality of sampling points in each of a plurality of scans of the surface, said polished state monitoring apparatus comprising:

a light emitting unit capable of emitting light for irradiating the surface;

control unit for controlling a sampling timing of the first characteristic values, and for receiving light reflected from the surface to generate the first characteristic values; and a calculating unit for calculating a plurality of second characteristic values by obtaining average values of a predetermined number of the first characteristic values which are obtained from adjacent sampling points in one scan of the surface, wherein at least one of the first characteristic values is used redundantly in calculating one of the second characteristic values and another of the second characteristic values.

2. A polished state monitoring apparatus according to claim 1, wherein said control unit is operable to detect an end point of the polishing in accordance with a pre-selected value from the second characteristic values.

3. A polished state monitoring apparatus according to claim 2, wherein the pre-selected value substantially corresponds to the center of the surface.

4. A polished monitoring apparatus according to claim 1, wherein said control unit is operable to monitor a time dependent variation of the second characteristic values and detect an end point of the polishing.

5. A polished state monitoring apparatus according to claim 4, wherein the polishing is stopped when a specified number of the second characteristic values reach the end point of the polishing.

6. A polished state monitoring apparatus according to claim 1, wherein said calculating unit is operable to calculate a plurality of third characteristic values by obtaining average values of a predetermined number of the second characteristic values which are obtained from the same sampling point of each of the scans of the surface, and wherein at least one of the second characteristic values is used redundantly in calculating one of the third characteristic values and another of the third characteristic values.

7. A polished state monitoring apparatus according to claim 6, wherein said control unit is operable to monitor a time dependent variation of the third characteristic values and detect an end point of the polishing.

8. A polished state monitoring method for monitoring the progress of polishing of a surface to be polished of an object by obtaining a plurality of first characteristic values indicating a state of the surface at each of a plurality of sampling points while scanning the surface, said method comprising:

scanning the surface a plurality of times;

obtaining the plurality of first characteristic values from a plurality of sampling points in each of the scans of the surface; and calculating a plurality of second characteristic values by obtaining average values of a predetermined number of the first characteristic values which are obtained from adjacent sampling points in one scan of the surface, wherein at least one of the first characteristic values is used redundantly in calculating one of the second characteristic values and another of the second characteristic values.

9. A polished state monitoring method according to claim 8, further comprising detecting an end point of the polishing in accordance with a pre-selected value from the second characteristic values.

10. A polished state monitoring method according to claim 9, wherein the pre-selected value substantially corresponds to the center of the surface.

11. A polished state monitoring method according to claim 8, further comprising:

monitoring a time dependent variation of the second characteristic values; and detecting an end point of the polishing.

12. A polished state monitoring method according to claim 11, wherein the end point of the polishing is detected when a specified number of sampling points among different sampling points reach the end point of the polishing.

13. A polished state monitoring method according to claim 8, further comprising calculating a plurality of third characteristic values by obtaining average values of a predetermined number of the second characteristic values which are obtained from the same sampling point of each of the scans of the surface, wherein at least one of the second characteristic values is used redundantly in calculating one of the third characteristic values and another of the third characteristic values.

14. A polishing state monitoring method according to claim 13, further comprising:

monitoring a time dependent variation of the second characteristic values; and detecting an end point of the polishing.

15. A polishing apparatus comprising a polished state monitoring apparatus as claimed in claim 1.

16. A polishing method for executing a polished state monitoring method as claimed in claim 8.

* * * * *